US006015018A

United States Patent [19]

Gazewood

[11] Patent Number: 6,015,018

[45] Date of Patent: Jan. 18, 2000

[54] METHOD AND APPARATUS FOR MOVING A PISTON

[76] Inventor: Michael J. Gazewood, 402 Machine Loop, Scott, La. 70583

[21] Appl. No.: 08/910,432

[22] Filed: Aug. 13, 1997

[51] Int. Cl.[7] ..... E21B 7/08

[52] U.S. Cl. ..... 175/57; 175/100; 175/94; 166/178

[58] Field of Search ..... 175/57, 61, 94, 175/100, 296, 340; 166/178

[56] References Cited

U.S. PATENT DOCUMENTS

| | | | |
|---|---|---|---|
| 4,106,571 | 8/1978 | Stone | 175/100 |
| 4,697,651 | 10/1987 | Dellinger | 175/94 |
| 4,705,118 | 11/1987 | Ennis | 175/65 |

*Primary Examiner*—William Neuder
*Attorney, Agent, or Firm*—Domingue & Waddell, PLC

[57] ABSTRACT

An apparatus for creating a pulling force on a bottom hole assembly contained within a bore hole is disclosed. Generally, the apparatus comprises a housing, a piston having a first section and a second section, and a venturi member, operatively associated with the piston, adapted for creating a zone of low pressure. In one embodiment, the housing is attached to a work string and the piston is attached to a bottom hole assembly. The first section of the piston and the housing forms a first chamber. The second section of the piston and the housing forms a second chamber. The venturi member contains a first passageway for communicating the zone of low pressure created by the venturi member with the first chamber; and a second passageway for communicating the inner diameter of the venturi means with the second chamber. In the preferred embodiment, the venturi member comprises a nozzle operatively associated with the piston; a mixing tube, formed on the inner diameter of the piston; and, a diffuser section adjoining the mixing tube. A method of moving a piston in a down hole environment is also disclosed.

18 Claims, 14 Drawing Sheets

METHOD AND APPARATUS FOR MOVING A PISTON

BACKGROUND OF THE INVENTION

The invention relates to a method and apparatus for moving a piston. More particularly, but not by way of limitation, the invention relates to a method and apparatus for urging a piston in order to generate a force relative to a housing by applying the venturi principle to a down hole apparatus.

In the development of oil and gas fields, well bores are drilled through subterranean reservoirs. Ultimately, a well will be completed to a hydrocarbon bearing reservoir, as will be understood by those of ordinary skill in the art. Afterwards, the hydrocarbon bearing reservoir is produced, and the hydrocarbons are ultimately sold.

The well bores are generally of small diameter and many times are highly deviated. The forces necessary to drill these well bores are significant. Many of the tools developed over the years depend on rotation of a tool string, gravitational forces, hydraulic forces and/or pneumatic forces. Moreover, during the completion phase, in order to accomplish the necessary procedures, the operator will find it necessary to employ the use of work strings that can transmit force in order to accomplish the completion and/or remedial work involved.

Sometimes, the force necessary to perform these operations is supplied with the work string weight. Other times, the force is supplied through rotation of the work string. Still yet other times the force is supplied through hydraulic means.

In those cases wherein the force required can not be generated due to lack of weight, rotation is not possible, excessive well bore angle, or the small diameter well bore limits tool function, operators have attempted various designs. For instance, down hole drilling motors have been developed that rotate a drill bit through fluid circulation. However, forces necessary to place the appropriate weight on bit may not be present due to the deviated nature of the well. Certainly, other factors may be present due to the specific circumstances of individual well bores that limit the application of force, and thus, limit the operators effectiveness to drill, complete and produce the well.

Therefore, there is a need for a method and apparatus that will allow for the application of a force regardless of the hole deviation, weight of the tool string, and/or lack of rotation.

SUMMARY OF THE INVENTION

A method of moving a piston in a down hole environment is disclosed. Generally, the piston is contained within a housing having an inner and outer diameter, with the piston being slidably received within the housing so that a chamber is formed. The piston will have attached thereon a venturi means for creating a zone of low pressure. The venturi means contains a first passageway means for communicating the chamber with the nozzle of the venturi means.

The method may comprise the steps of circulating a fluid through the inner diameter of the housing so that the fluid is funneled through the venturi means. Then, a zone of low pressure is created about the nozzle of the venturi means which is communicated with the chamber. In response to the low pressure, the chamber fluid is evacuated which in turn urges the piston outward relative to the housing.

The circulation of fluid through the inner diameter of the work string will also act on a shoulder of the piston which will cause a force against this shoulder so that the piston is urged outward relative to the housing.

The method may also entail terminating the injection of the fluid and equalizing the pressure within the pressure chamber with the fluid system pressure so that the piston is no longer urged outward relative to the housing. The operator may then begin circulating the fluid into the internal diameter of the work string again and funneling the fluid through the venturi means. The venturi means will create a zone of low pressure about the nozzle that will be communicated with the pressure chamber. In turn, the piston will be urged outward relative to the housing thereby creating a pushing force on the piston which can be transferred to a device attached to the piston.

In one embodiment, the housing is attached to a work string and the piston is attached to a bit means for drilling a bore hole. Thus, the method further comprises rotating the work string so that the bit means drills the bore hole. The venturi means, as described earlier, will drive the piston outward relative to the work string so that the bit means is pushed into the formation face of the subterranean reservoir of the bore hole being drilled.

An apparatus for creating a pulling force on a bottom hole assembly contained within a bore hole is also disclosed. Generally, the apparatus comprises a housing, a piston having a first section and a second section, and a venturi means, operatively associated with the piston, for creating a zone of low pressure.

In one embodiment, the housing is attached to a work string and the piston is attached to a bottom hole assembly. The first section of the piston and the housing forms a first chamber. The second section of the piston and the housing forms a second chamber. The venturi means contains a first passageway means for communicating the zone of low pressure created by the venturi means with the first chamber; and a second passageway means for communicating the inner diameter of the venturi means with the second chamber.

The venturi means may have attachment means for attaching to a first end of the first section and second section of the piston so that the venturi means, and in particular the nozzle, is detachable and interchangeable from the piston. In the preferred embodiment, the venturi means comprises a nozzle operatively associated with the piston; a mixing tube, formed on the inner diameter of the piston; and, a diffuser section adjoining the mixing tube.

In accordance with the teachings of this invention, the bottom hole assembly may contain a bit means for drilling a bore hole. In another embodiment, the bottom hole assembly may contain jarring means for imparting a jarring impact to the bottom hole assembly during operations, and wherein the jarring means is attached to the piston. In another embodiment, the bottom hole assembly contains a pulling tool wherein the piston is attached to the pulling tool so that during operation, the piston transfers the pulling force to the pulling tool. In yet another embodiment, the work string may be a coiled tubing string, a drill string or even a production string.

An advantage of the present invention is that in one embodiment, the power piston creates a pulling force relative to the housing, and in a different embodiment, the power piston creates a pushing force relative to the housing. Another advantage is the venturi means may be interchanged at the option of the operator from the force generator set to pull relative to the work string or from the force generator set to push relative to the work string.

Another advantage is that the apparatus herein disclosed functions in highly deviated and horizontal wells. Still yet another advantage includes the ability to use different types of work strings with the invention. Yet another advantage includes adapting different types of bottom hole assemblies with the invention.

Still yet another advantage is that the generation of either the pulling or pushing force is created by the venturi means as well as the force created by the circulation of the fluid against the shoulder of the venturi means. Another advantage is that the apparatus may be used in a variety of applications, for instance with a bit, jarring apparatus, pulling/retrieving tools. This list is illustrative.

A feature of the present invention includes the piston and housing forms a chamber. Another feature includes the venturi means creates a zone of low pressure about the nozzle. Another feature is that the apparatus may be utilized on a variety of diameter work strings and bottom hole assemblies.

Yet another feature includes a first passageway communicates the zone of low pressure with the first chamber. Another feature includes a second passageway that communicates the high pressure of the internal fluid with the second chamber. Still yet another feature includes a totally sealed chamber so that the chambers can. not be contaminated.

Yet another feature includes a nozzle that is interchangeable. Thus, if the nozzle size is incorrect, the operator may simply change out nozzles. Alternatively, by changing nozzles, it is possible to change the device from a pull-force generating device to a push-force generating device. Still yet another feature includes the generation of the push or pull force is activated or terminated by the circulation of fluid through the venturi means.

DESCRIPTION OF THE PREFERRED EMBODIMENTS

Figure 1:
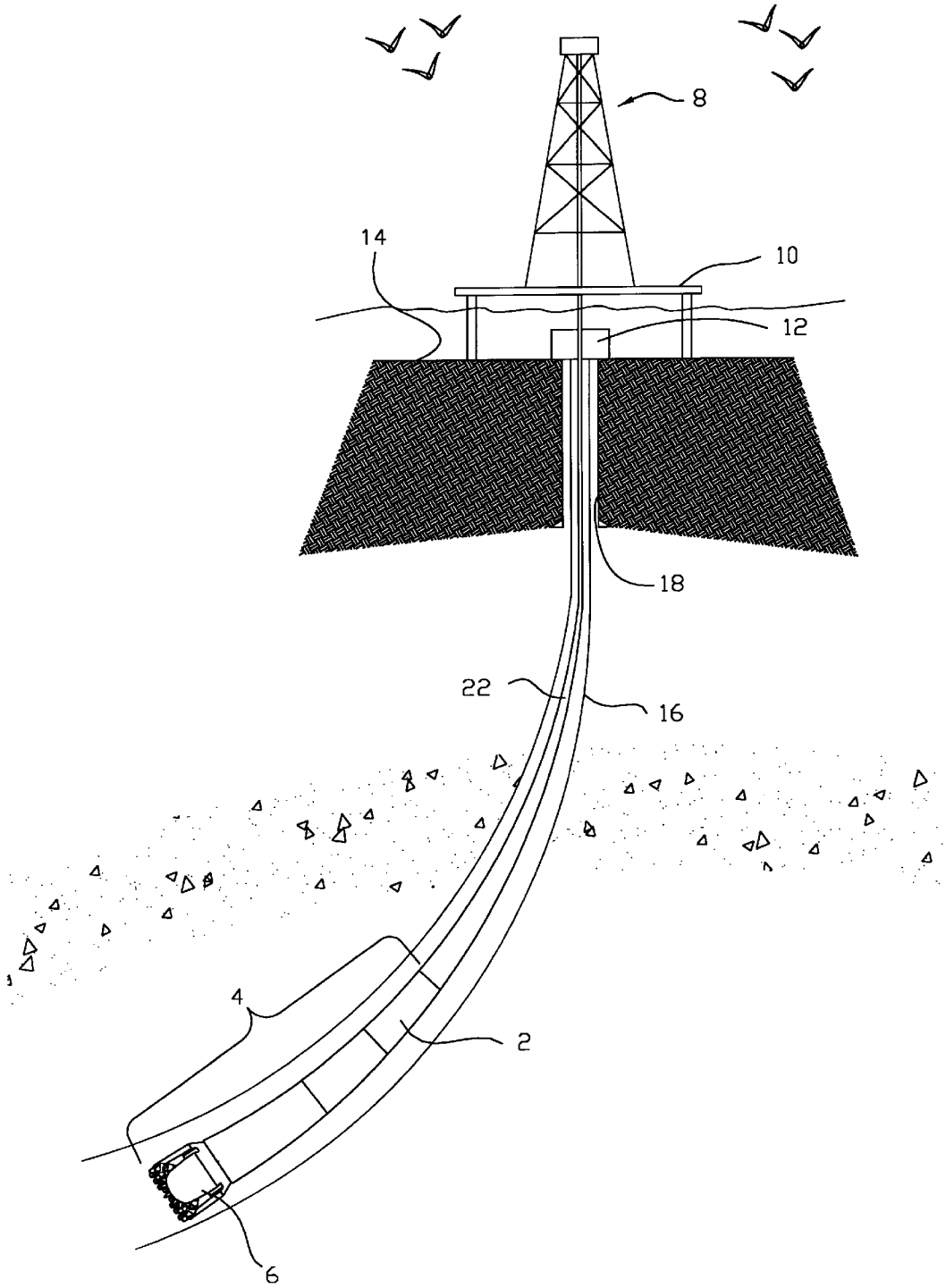
FIG. 1 depicts a drilling rig with a work string extending therefrom in deviated well.

Referring now to FIG. 1, the force generator apparatus 2 is shown as part of a bottom hole assembly 4 that includes a drilling bit means 6 for drilling a bore hole including but not limited to tri-cone, PDC, etc. As depicted in FIG. 1, a drilling rig 8 is situated on a drilling platform 10 that may be a semi-submersible drilling rig. A sub-sea tree 12 is situated on the sea floor 14 which isolates the bore hole 16, surface casing 18 and intermediate casing (not shown) as is well understood by those of ordinary skill in the art.

A work string 22 extends from the drilling rig 8. The work string 22 may be drill pipe, coiled tubing, snubbing pipe, or production string. This list is illustrative. The work stringy will have a bottom hole assembly 4 attached thereto that may include a drilling motor, bent sub, and measurement while drilling devices (not shown). As shown, the bit 6 has drilled the bore hole 16.

As will be understood by those of ordinary skill in the art, an important factor in drilling efficiency and speed is the proper weight on the bit 6. As the angle of the bore hole 16 deviates from vertical to horizontal, the driller has a more difficult time applying weight on the bit. An advantage of the present invention is that the application of force to the bit 6 is now possible with application of the present invention as will be more fully understood hereinafter.

The present invention is applicable to many other uses within a well such as during a completion or workover. Thus, when a force is required relative to a work string 22, the present invention supplies that force either in a outward movement relative to the work string or an inward movement relative to the work string, as will be more fully explained hereinafter. It should be noted that through out the description, like numbers refer to like components in the drawings.

Figure 2:
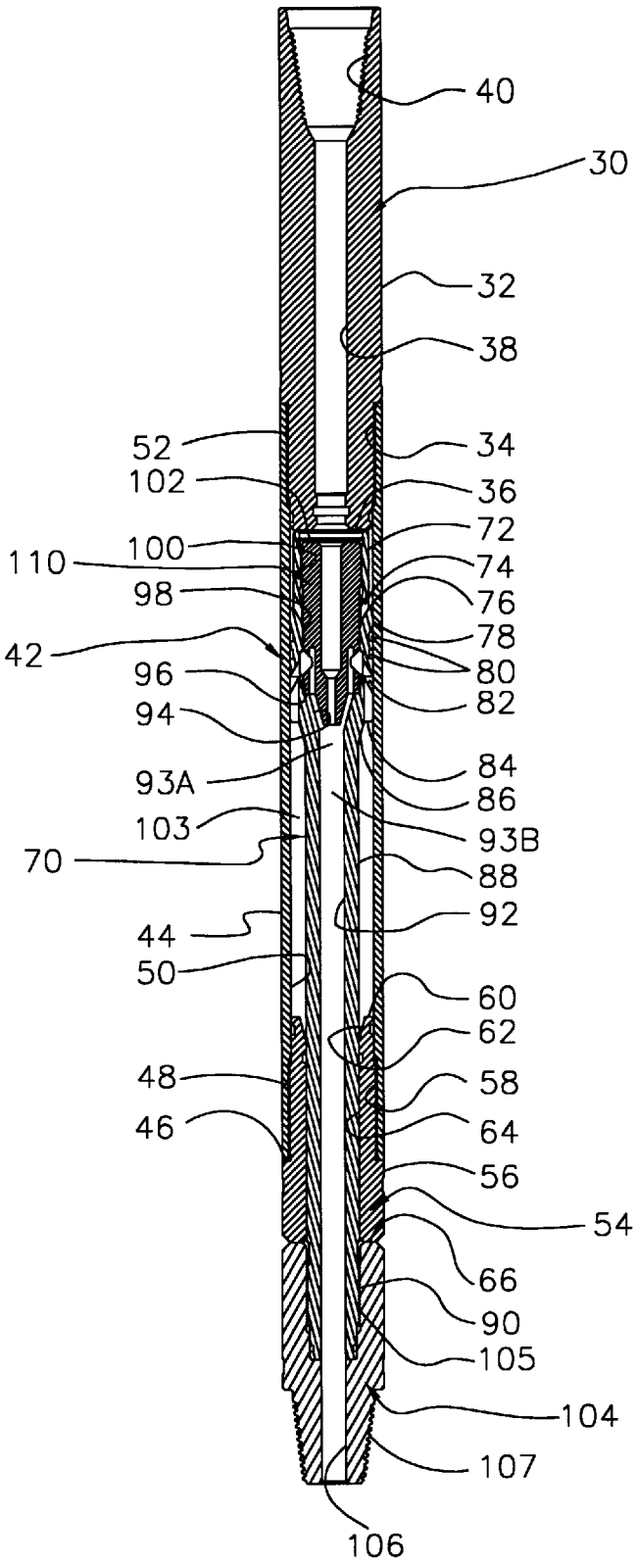
FIG. 2 is a sectional view of one embodiment of the present invention set to generate a pushing force relative to the housing.

Referring now to FIG. 2, an embodiment of the present invention will now be explained. The apparatus generally comprises an upper housing member 30 that has an outer surface 32 that extends to an external thread means 34 that in turn extends to a radial shoulder 36. An inner bore 38 extends radially inward from the shoulder 36 and terminates at the internal thread means 40.

An intermediate housing 42 contains an outer surface 44 that terminates at the radial shoulder 46. Extending radially inward from shoulder 46 is the internal thread means 48 that in turn extends to the inner bore 50, with the bore 50 terminating at the internal thread means 52. The lower housing 54 generally includes an outer surface 56 that has external thread means 58 that concludes at the shoulder 60. Extending radially inward will be the chamfered shoulder 62 that extends to the inner bore 64, with the inner bore terminating at the shoulder 66.

A power piston 70 is slidably disposed within said housing members 42, 54. Generally, the power piston 70 comprises a first outer surface 72 that has disposed therein a first passageway means 74. The outer surface 72 terminates at the shoulder 76 that in turn extends to the second outer surface 78, with the outer surface having contained thereon grooves 80 for placement of seal means (not shown) such as o-rings. The second outer surface 78 will also contain a second passageway means 82. The second outer surface 78 terminates at the shoulder 84.

A chamfered surface a extends from the shoulder 84 that in. turn stretches to the outer diameter surface 88. The outer diameter surface concludes at the external thread means 90. Extending radially inward is the first internal bore 92 that will. stretch to the chamfered surface 94 that in turn terminates at the shoulder 96. A second internal bore 98 is included, with the second internal bore 98 including the first passageway means 74 and the second passageway means 82. The second internal bore 98 extending to the internal thread means 100, with the internal thread means concluding at the end shoulder 102. The power piston 70 and the intermediate housing member 42 form the chamber 103.

The power piston 70 will have attached to the thread means 90 the sub 104 that contains internal thread means 105 that stretches to an internal bore 106, as well as external thread means 107.

Figure 3:
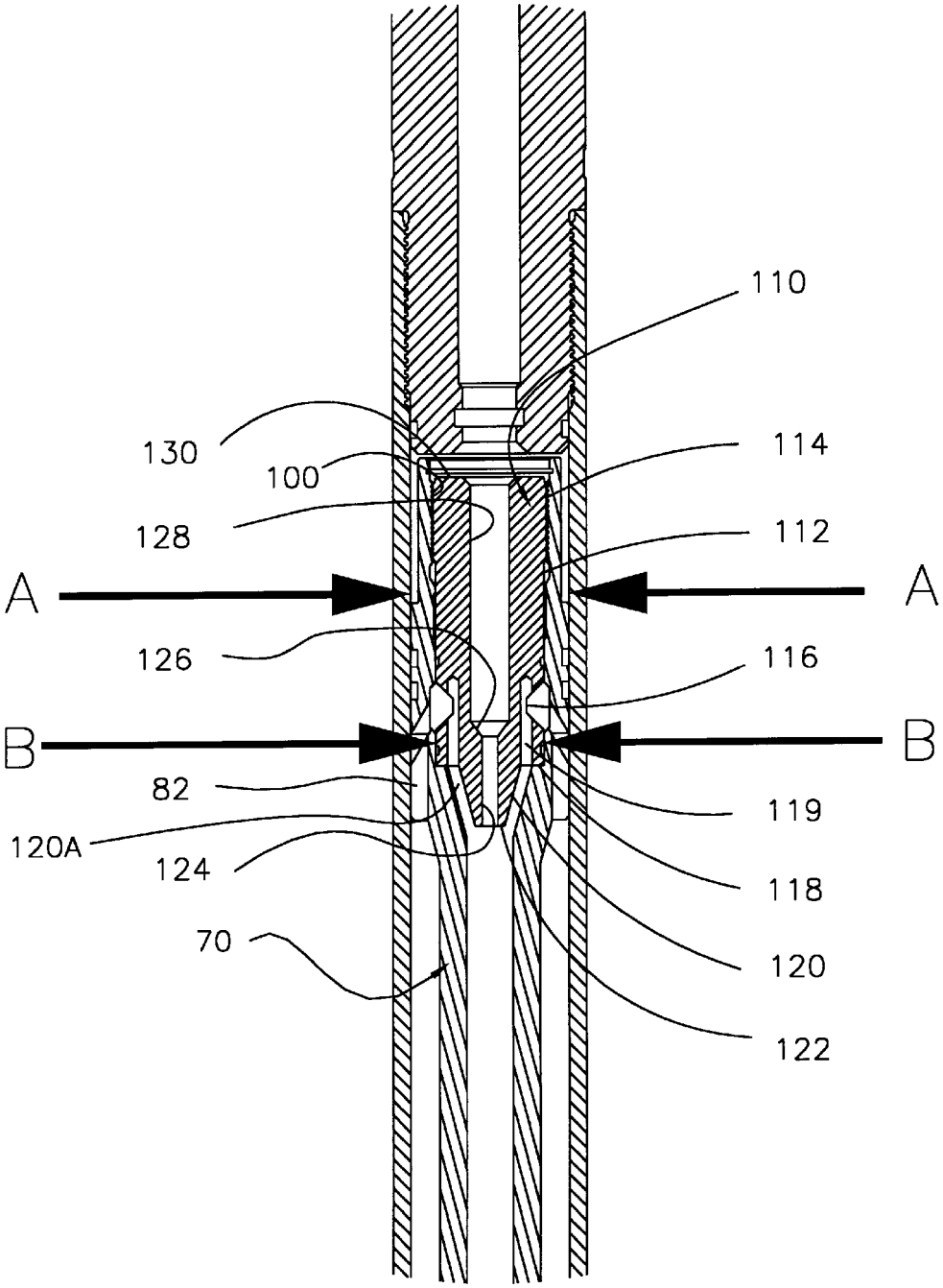
FIG. 3 is an enlarged sectional view of the venturi means of FIG. 2.

Referring to FIG. 3, the venturi means 110 for creating a zone of low pressure will now be described. The venturi means generally comprises an outer surface 112 that has contained thereon external thread means 114 that will cooperate with the internal thread means 100. The outer surface 112 will also contain a recess 116, with the recess being in communication with the second passageway 82. The outer surface 112 concludes at the shoulder 118, with the shoulder having formed therein a lateral passageway 119, with the lateral passageway 119 communicating with the recess 116. An angled surface 120 extends from the shoulder 118 and forms the nozzle 120. The nozzle annulus is seen generally at 120A.

The nozzle 120 concludes at the shoulder 122 and thereafter extends radially inward to the first inner bore 124. The first inner bore 124 extends to the chamfered surface 126 which in turn stretches to the second inner bore 128 which concludes at the end shoulder 130.

Figure 4:
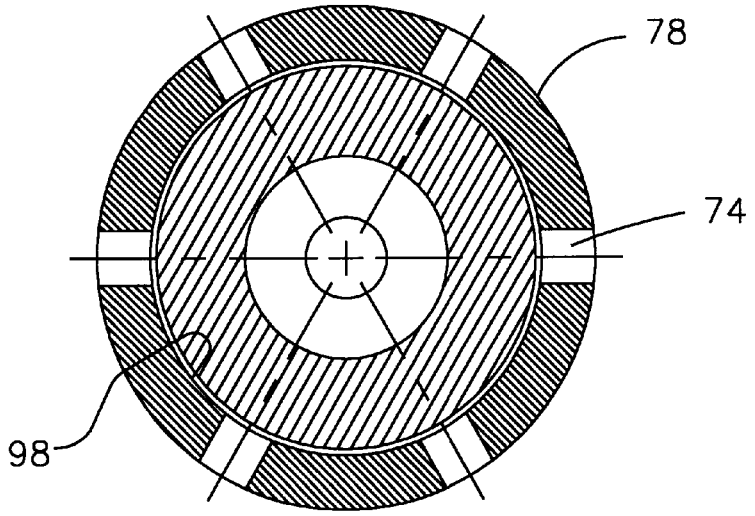
FIG. 4 is a cross-section of the apparatus taken along the line A—A of FIG. 3.
Figure 5:
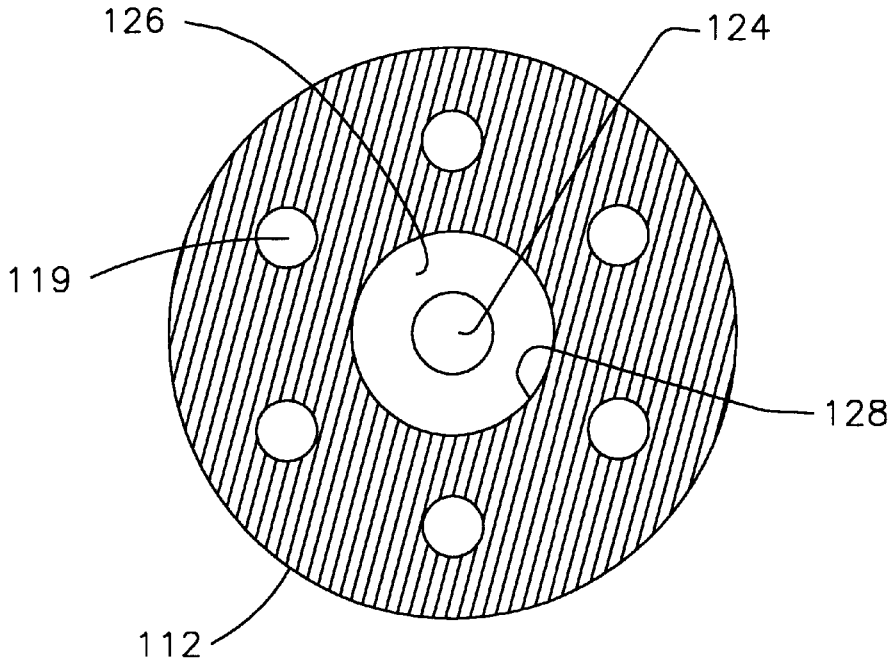
FIG. 5 is a cross-section of the apparatus taken along the line B—B of FIG. 3.

Referring now to FIG. 4, a cross-section of the apparatus taken along the line A—A from FIG. 2 is illustrated. Thus, the outer surface 78 is shown with the inner bore 98 along with the plurality of first passageways 74. Referring now to FIG. 5, a cross-section of the apparatus taken along the line B—B of venturi means 110 of FIG. 3 is shown. Thus, the outer surface 112 is shown, with the plurality of lateral passageways 119 contained within the venturi means 110. The inner bore 124 is also shown.

Figure 6:
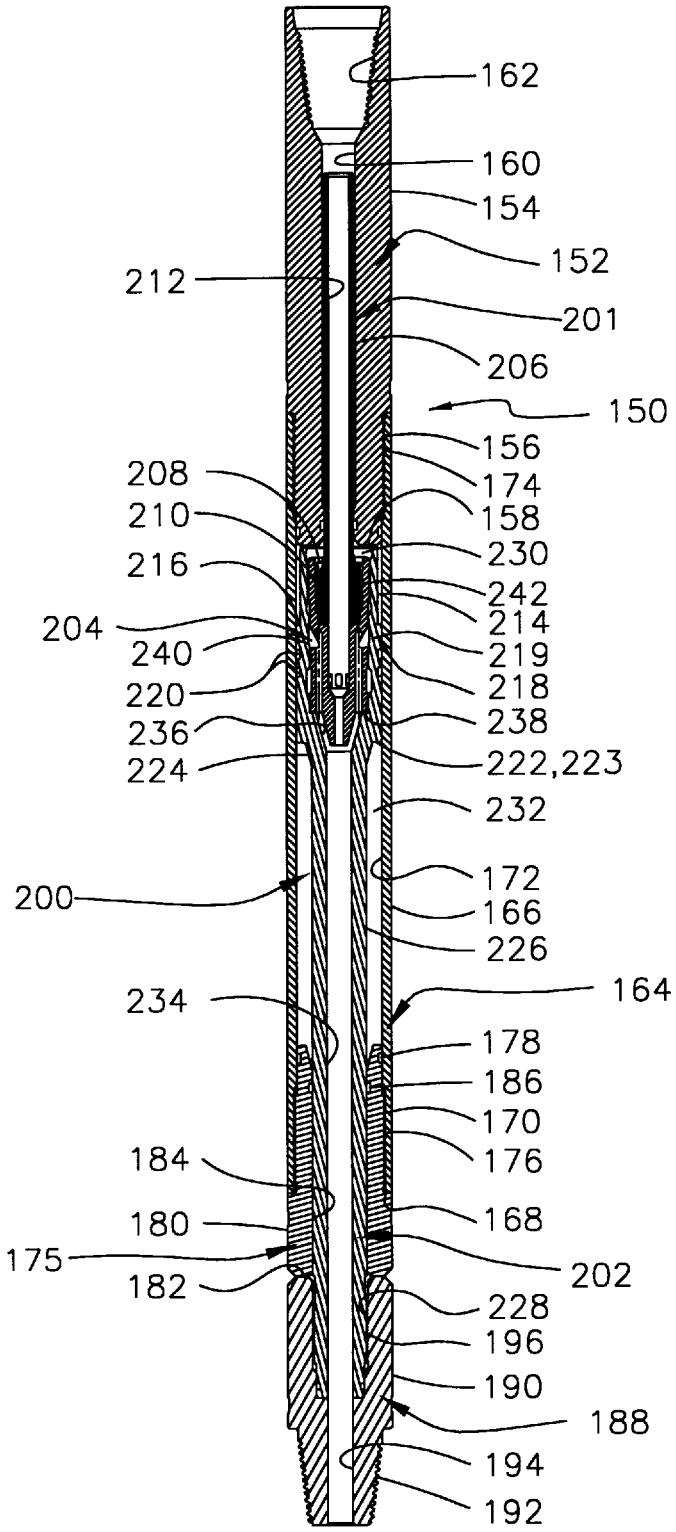
FIG. 6 is a sectional view of a second embodiment of the present invention set to generate a pulling force relative to the housing.

A second embodiment of the invention is depicted in FIG. 6. As shown, the apparatus 150 contains an upper housing member 152 that will contain an outer surface 154 that contains the external thread means 156, with the outer surface 154 concluding at the end 158. Extending radially inward is the inner bore surface 160 that concludes at the internal threads 162.

The intermediate housing 164 includes an outer surface 166 that will terminate at the end 168. Extending radially inward will be the internal thread means 170 that in turn continues to the inner bore surface 172 which will then conclude at the internal thread means 174. The housing member of FIG. 6 may also include a lower housing member 175 that has an external thread means 176 that mates with the thread means 170 as well as an o-ring groove 178. The external thread means 176 extends to the outer surface 180 which in turn concludes at the end 182. The internal bore surface 184 also includes a groove 186 for placement of a seal means (not shown) for sealingly engaging with the surface 226. A sub 188 is also included that contains an outer surface 190 that extends to external thread means 192. Extending radially inward will be the inner bore surface 194 that extends to the inner thread means 196.

The embodiment of FIG. 6 will contain a power piston 200 that comprises a first section 201 and a second section 202. The first section 201 and second section 202 are operatively associated with the venturi means 204 for creating a zone of low pressure as will be more fully explained later in the application.

The first section 201 of the power piston 200 includes an outer surface 206 that extends to the shoulder 208 which in turn concludes at the external thread surface 210. The first section 201 will have an inner bore surface 212. The second section 202 includes a first outer surface 214 that extends to the shoulder 216 that in turn stretches to a second outer surface 218.

The first outer surface contains a passageway means 219 for allowing passage of fluid as will be fully explained later in the application. The second outer surface 218 will have grooves 220 for placement of o-ring sealing means. The second outer surface 218 concludes at the shoulder 222. The shoulder 222 will have disposed therein a passageway means 223 for allowing passage of fluid as will be fully explained later in the application.

The shoulder 222 will extend to the chamfered surface 224 which in turn continues to the second outer surface 226. The outer surface 226 will contain external thread means 228 that will cooperate with the thread means 196. As depicted in FIG. 6, the power piston first section 201 forms a chamber 230 with reference to the housing member 164. The power piston second section 202 forms a chamber 232 with reference to the housing member 164.

The second section 202 of the power piston 200 will have a first inner bore surface 234 that stretches to the chamfered surface 236 which in turn leads to the shoulder 238. A second inner bore surface 240 is provided that contains the previously mentioned passageways 219 and 223, as well as the internal thread means 242 which cooperate with the venturi means 204.

Figure 7:
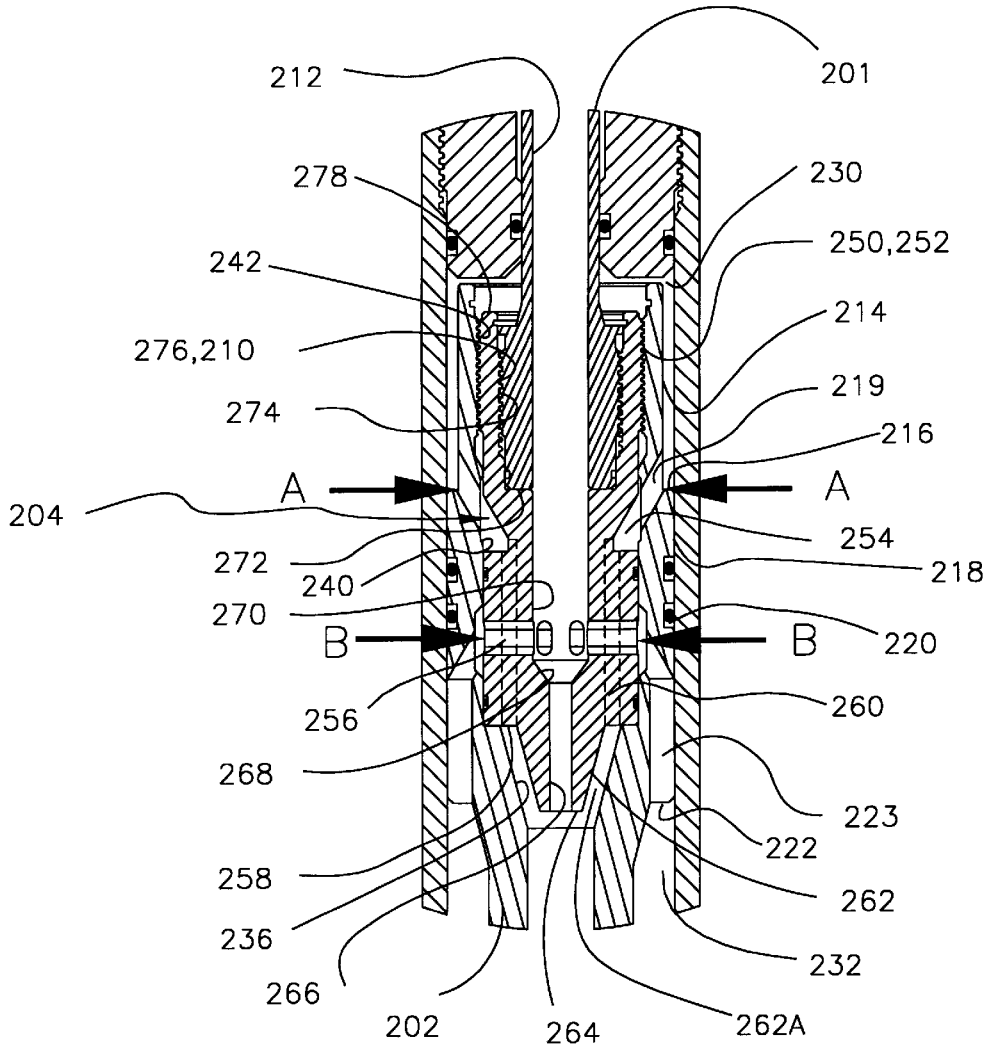
FIG. 7 is an enlarged sectional view of the venturi means of FIG. 6.

Referring now to FIG. 7, an enlargement of the venturi means 204 is illustrated. Generally, the venturi means 204 contains an outer surface 250 that will contain external thread means 252 that will cooperate with the internal thread means 242 of the second power piston section 202. The outer surface 250 will contain a passageway means 254 for allowing passage of fluid and pressures and that cooperates with the passageway 219 of the second power piston section 202. The outer surface 250 will also contain axial passageway means 256 for allowing passage of fluid and pressures and that cooperates with the passageway 223 of the second power piston section 202.

The outer surface 250 will conclude at the radial shoulder 258. The radial shoulder 258 contains a plurality of lateral passageways 260 for communicating the passageway means 254 with the nozzle area of the venturi means 204 (lateral passageway 260 shown in FIG. 9). The outer surface extends to the conical surface 262, which is referred to as the nozzle 262, with the nozzle terminating at the tip 264. As can be seen, the nozzle 262 is contoured to adapt and cooperate with the chamfered surface 236. The nozzle annulus is seen generally at 262A.

The venturi means 204 will contain a first inner bore surface 266 which in turn extends to the chamfered surface 268. A second inner bore surface 270 that has contained therein the axial passageways 256 is provided, with the second inner bore terminating at the radial surface 272. The radial surface concludes at the third inner bore surface 274, with the inner bore surface 274 having contained thereon internal thread means 276 that cooperate with the external thread means 210 and the third inner bore surface 274 concludes at end 278.

Figure 8:
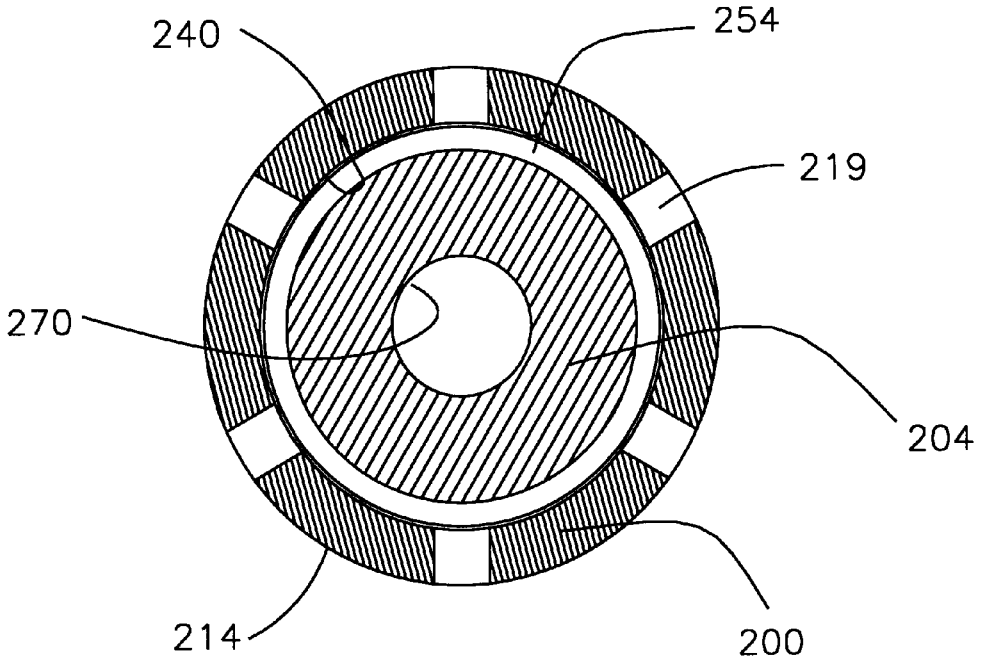
FIG. 8 is a cross-section of the apparatus taken along line A—A of FIG. 7.
Figure 9:
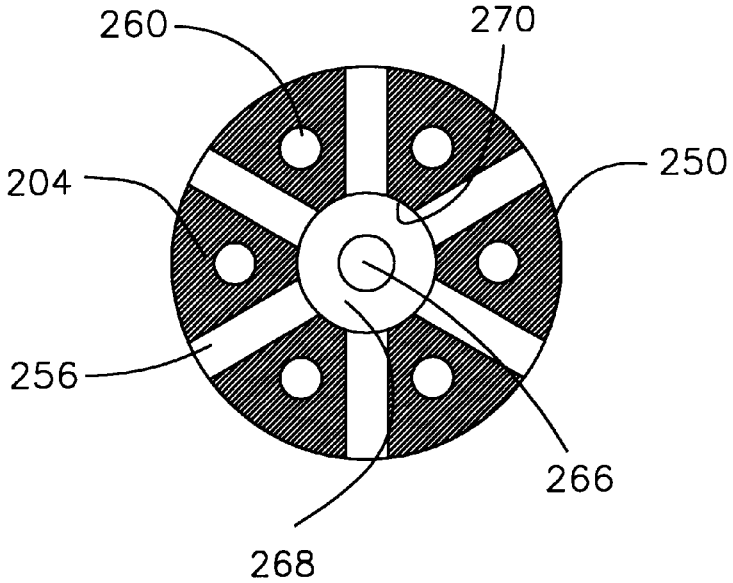
FIG. 9 is a cross-section of the venturi means taken along line B—B of FIG. 7.

Referring now to FIG. 8, which is a cross section of the power piston 200 taken along line A—A of FIG. 7, the drawing depicts the plurality of passageways 219. FIG. 9 which is a cross section of the venturi means 204 taken along line B—B of FIG. 7, depicts the axial passageway 256 as well as the lateral passageway 260.

Figure 10:
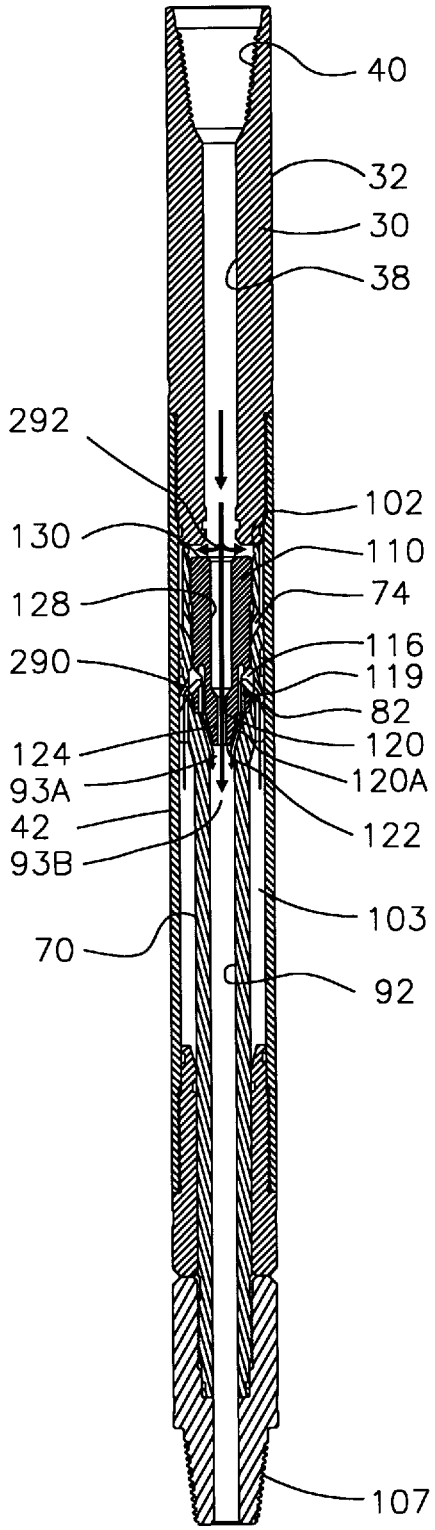
FIG. 10 is the force generator embodiment of FIG. 2 set to create a pushing force.
Figure 11:
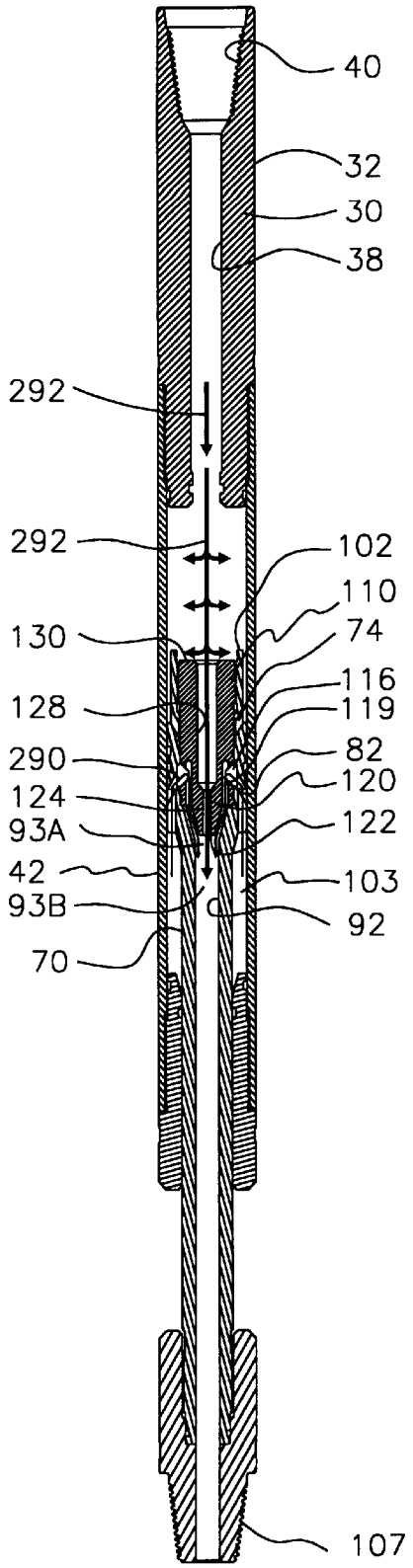
FIG. 11 is the force generator embodiment of FIG. 10 in the process of creating a pushing force.
Figure 12:
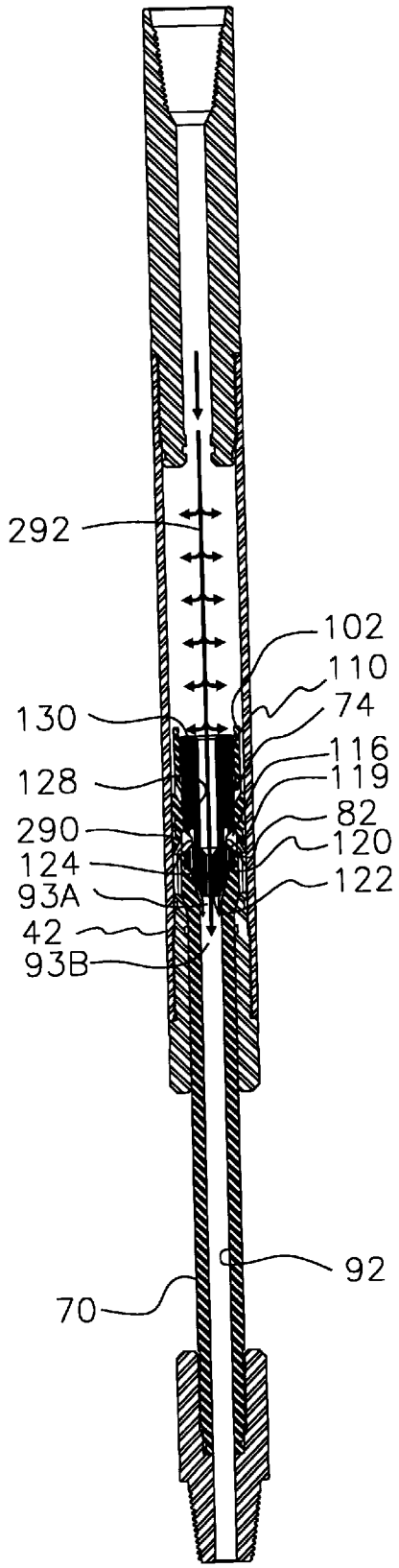
FIG. 12 is the force generator embodiment of FIG. 11 creating a pushing force.

The operation of the apparatus will now be described. The FIGS. 10, 11, and 12 depict the sequence of extending said power piston 70. Referring now to FIG. 10, the force generator of FIG. 2 is positioned in order to create a pushing force. The upper housing 30 will be connected to a work string such as a drill string, coiled tubing, snubbing unit, etc. The operator will pump a fluid down the internal diameter of the work string, which will in turn enter the inner bore 38 of the housing 30.

The fluid will then enter the inner bore 128 of the venturi means 110 and ultimately funneled into the reduced bore 124. As the fluid exits the nozzle tip 122 and into the throat 93A and diffuser 93B, a pressure decrease is experienced due to the venturi effect. The pressure decrease is experienced within the nozzle annulus area 120A.

The pressure/velocity transfer is achieved through energy transfer between the high pressure circulation fluid and the fluid within the chamber. The high pressure circulation fluid exits the nozzle tip 122 at a high velocity. The pressure at the entrance of the throat 93A becomes lower which is known as the venturi effect. The area between the nozzle 120 and the chamfered surface 94 of the power piston 70 also experiences a decrease in pressure, with this pressure decrease being transferred to the lateral passageway 119. When this pressure becomes lower than the pressure in the lateral passageway 119, fluid is drawn from the chamber 103 and is entrained with the high velocity fluid exiting the nozzle tip 122.

As mentioned earlier, the lateral passageway 119 is in communication with the passageway 82. Thus, the pressure decrease is transferred via the passageways 119, 82 to the chamber 103, which in turn evacuates the chamber 103 depicted by the arrows 290. At the same time, the fluid being pumped down the internal diameter 38 will act against the venturi means 110 (depicted by the arrows 292), and in particular the shoulder 130. Thus, the power piston 70 is pushing outward relative to the housing 42 by the force created by the venturi means 110 as well as the force created by the fluid against the shoulder 130.

Referring to FIG. 11, the drawing depicts where the power piston 70 has been partially withdrawn i. e. in the process of being extending. It should be noted that this may also be the position of the power piston 70 if in the process of pushing, the force against which it is pushing exerts an opposing and counter acting force. In FIG. 12, the power piston 70 has been completely extended, and continued pumping will maintain a vacuum on the chamber 103 as well as act against the shoulder 130. In this position, the chamfered shoulder 86 of the power piston 70 and the chamfered shoulder 62 abut each other. Regardless of the type of device which is attached to the power piston 70 via thread means 107, the device will be forced outward relative to the housing 30, 42. If the housing 30, 42 is connected to a drill string, then the piston 70 is forced outward relative to the drill string.

Figure 13:
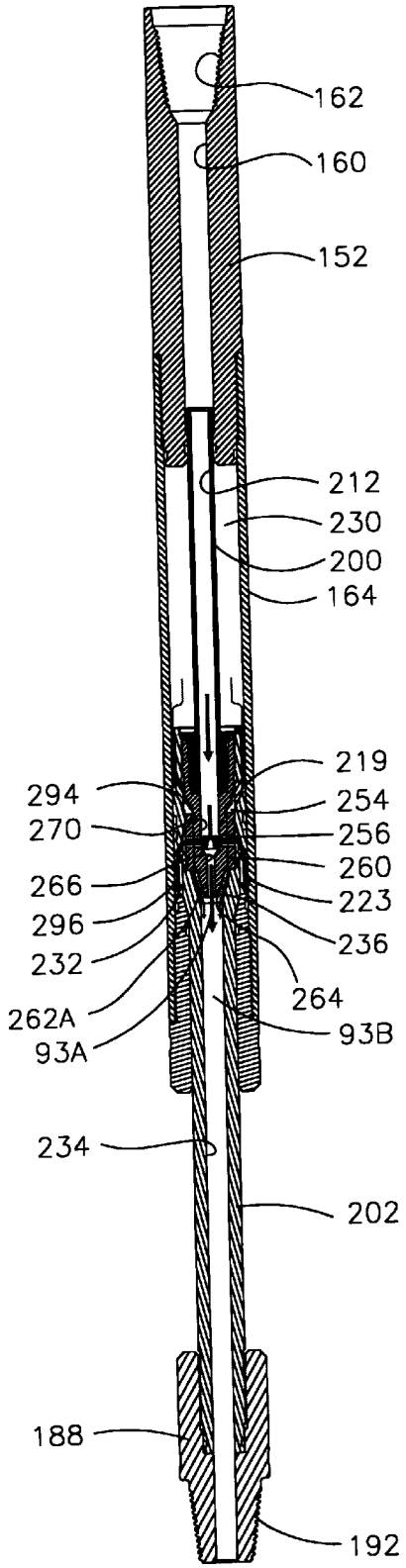
FIG. 13 is the force generator embodiment of FIG. 6 set to create a pulling force.
Figure 14:
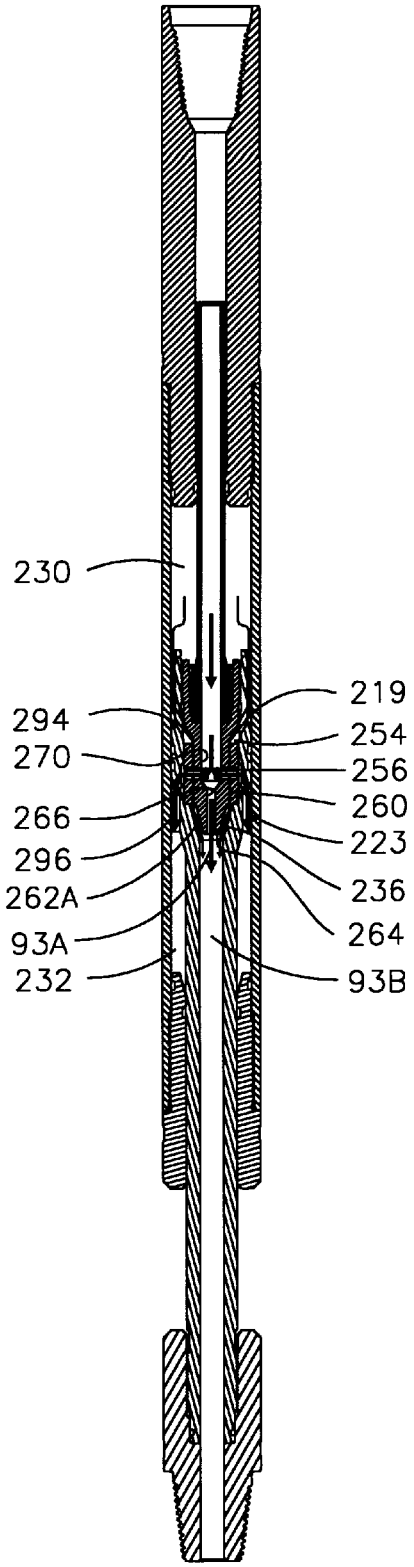
FIG. 14 is the force generator embodiment of FIG. 13 in the process of creating a pulling force.
Figure 15:
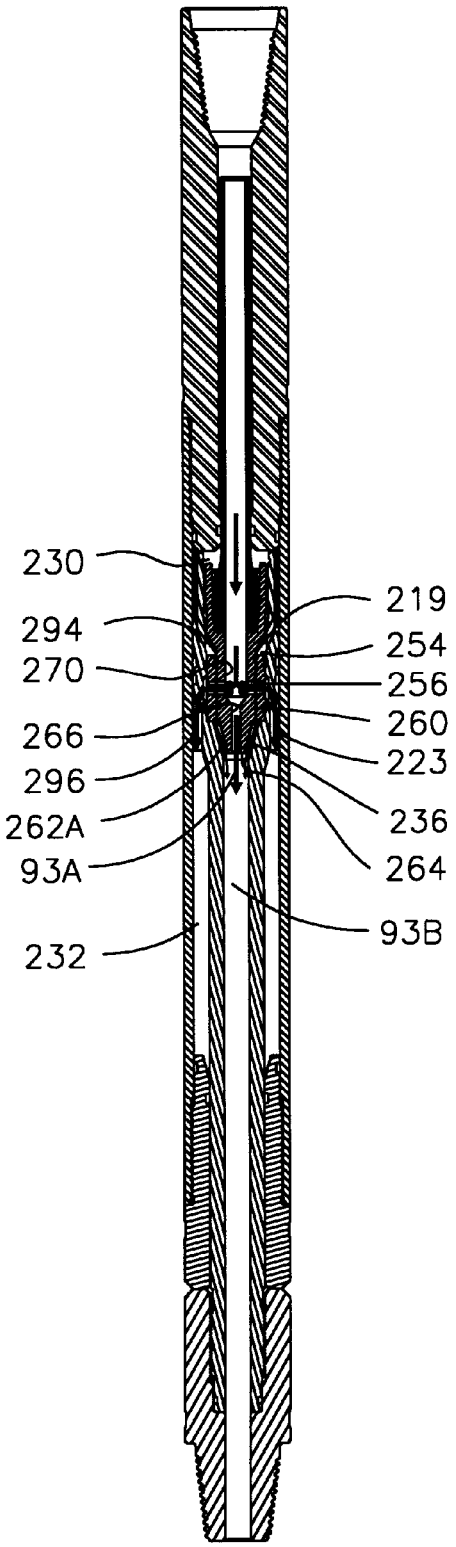
FIG. 15 is the force generator embodiment of FIG. 14 creating a pulling force.

The FIGS. 13, 14, and 15 depict the sequence of contracting said power piston 200 of the second embodiment of the present invention. Referring now to FIG. 13, the force generator of FIG. 6 is positioned initially so that the power piston 200 is in the extended position, and the power piston 200 will contract in order to create a pulling force. The upper housing 152 will be connected to a work string such as a drill string, coiled tubing, snubbing unit, etc. The operator will pump a fluid down the internal diameter of the work string, which will in turn enter the inner bore 160 of the housing 152.

The fluid will proceed through the first section of the power piston 201, and then enter the inner bore 270 of the venturi means 204 and ultimately funneled into the reduced bore 266. As the fluid exits the nozzle tip 264, a pressure decrease is experienced, due to the venturi effect as explained earlier. The pressure decrease is experienced within the nozzle annulus 262A. Thus, the area between the nozzle 262 and the chamfered surface 236 of the second section of the power piston 202 experiences a decrease in pressure, with this pressure decrease being conveyed to the lateral passageway 260.

The lateral passageway 260 is in communication with the passageway 254, and passageway 254 is in communication with passageway 219. Thus, the pressure decrease is transmitted via the passageways 260, 254, and 219 to the chamber 230, which in turn evacuates the chamber 230 (as depicted by the arrows 294) and causes a pressure decrease within chamber 230.

With reference to FIG. 14, and essentially at the same time, the fluid being pumped down the internal diameter 160 and into the inner bore 270 of the venturi means 204 will be at a higher pressure than the pressure within the chamber 230. The inner bore 270 is in pressure communication with the chamber 232 via the axial passage 256 and passage 223. At the same time, the fluid within the chamber 230 will be subjected to a suction pressure via passageways 254, 260 being in communication with nozzle annulus 262A. Thus, the high pressure within the inner bore 270 will enter the chamber 232 and also act to retract the power piston 200 as seen by the arrows 296 by the expansion of chamber 232. Thus, if a tool is attached to the sub 188 via threads 192, the tool will be pulled inward relative to the housing 152 by the force created by the venturi means 110 (the 294 arrow) as well as the force created by the high pressure fluid entering chamber 232 (the 296 arrow). Therefore, the chamber 230 is essentially emptied by placing a vacuum via the connection with the venturi means 204, while the chamber 232 if filled via the connection with the inner diameter of the venturi means 204.

In FIG. 15, the power piston 200 has been completely retracted relative to the housing 152, 164, and continued pumping will maintain a vacuum on the chamber 230 as well as acting to fill the chamber 232 with the high pressure fluid. Regardless of the type of device which is attached to the power piston 200 via thread means 192, the piston 200 will be forced inward relative to the housing 152, 164.

Figure 16:
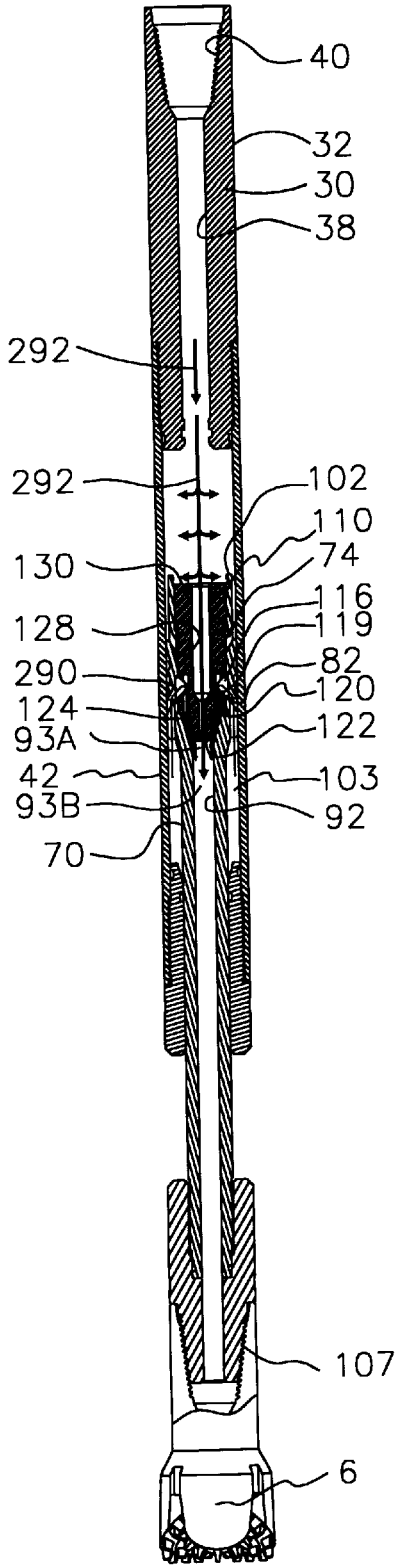
FIG. 16 is the force generator embodiment of FIG. 6 operatively associated with a bit.

As depicted in FIG. 16, the power piston 70 is operatively associated with a bit means 6 for drilling a bore hole. Generally, with a bit means 6, the apparatus that will be employed will be the embodiment of FIG. 2 so that the apparatus generates a pushing force. This will have the effect of pushing the bit means 6 into the formation face of the bore hole, which is always useful in optimizing drilling efficiency and speed. A tri-cone type of bit is shown; however, any other type of bit means are available such as the PDC bit.

This embodiment is particularly useful in highly deviated wells and horizontal wells. Thus, as drilling proceeds and fluid is circulated within the work string, the venturi means 110 will cause (as previously described in the sequence of FIGS. 10 to 12) the power piston 70 to extend so that the bit means 6 is forced into the formation face.

The teachings of this invention include the use of numerous types of devices that may be attached to the power piston of either embodiment. Thus, while a bit means 6 is shown, other types of devices such as pulling tools, and jars may be utilized.

Changes and modifications in the specifically described embodiments can be carried out without departing from the scope of the invention which is intended to be limited only by the scope of the appended claims.

I claim:

1. A method for moving a piston comprising the steps of:

providing a housing having an inner and outer diameter, with said piston being slidably received within said inner diameter of said housing and forming a chamber and a first shoulder and a second shoulder, said piston having attached thereon a venturi means for creating a zone of low pressure, and wherein said venturi means contains a nozzle member and a first passageway means for communicating the chamber with the nozzle member;

circulating a fluid through the inner diameter of said housing;

funneling the fluid through said venturi means;

exiting the fluid out of said nozzle member;

creating a zone of low pressure about said nozzle member;

evacuating the fluid in said chamber via said first passageway means;

urging said piston continuously downward relative to said housing during said circulating of the fluid through the inner diameter of said housing;

forcing the fluid on said second shoulder of said piston;

urging said piston continuously downward relative to said housing.

2. The method of claim 1 further comprising the steps of:

terminating the injection of the fluid;

equalizing the pressure within said chamber with the fluid within the inner diameter of said housing.

3. The method of claim 2 further comprising the steps of:

circulating the fluid through the inner diameter of said housing;

funneling the fluid through said venturi means;

exiting the fluid out of said nozzle member;

creating a zone of low pressure about said nozzle member;

urging said piston continuously downward relative to said housing during said circulating of the fluid through the inner diameter of said housing.

4. The method of claim 3 wherein said housing is attached to a work string and said piston is attached to a bit means for drilling a bore hole and the method further comprises:

rotating said work string so that said bit means drills the bore hole;

urging said piston downward relative to said housing so that said bit means is pushed into said bore hole.

5. An apparatus comprising:

a housing member having an inner portion and an over portion;

a piston slidably received within said housing member, with said piston and said housing member forming a pressure chamber and an annulus area;

venturi means, attached to said piston, for creating a zone of low pressure with said pressure chamber and wherein said venturi means comprises a nozzle operatively associated with said piston, a mixing tube formed on said inner diameter of said piston and a diffuser section formed on said inner diameter of said piston and adjoining said mixing tube;

passageway means, operatively associated with said venturi means, for communicating the zone of low pressure with said pressure chamber including a first passageway means, located on said venturi means, for transmitting the zone of low pressure and a second passageway means, located on said piston and operatively associated with said first passageway means, for transmitting the zone of low pressure with said pressure chamber.

6. The apparatus of claim 5 wherein said housing is attached to a work string and said piston is attached to a bit means for drilling a bore hole.

7. The apparatus of claim 6 wherein said nozzle is interchangeable with said piston and further comprising a second nozzle that includes a first end and a second end, and wherein said second nozzle has an inner diameter and an outer diameter that is of a different size from said first nozzle.

8. An apparatus for creating a pulling force on a bottom hole assembly contained within a borehole comprising:

a housing attached to a work string;

a piston attached to said bottom hole assembly, said piston having a first section and a second section and wherein said first section of said piston forms a first chamber and said second section of said piston forms a second chamber;

a venturi device operatively associated with said piston, for creating a zone of low pressure and wherein said venturi means contains a first passageway means for communicating the zone of low pressure with said first chamber, and second passageway means for communicating the inner diameter of said venturi means with said second chamber.

9. The apparatus of claim 8 wherein said venturi means has an inner diameter with a first attachment means for attaching the inner diameter to a first end of said first section of said piston and an outer diameter with a second attachment means for attaching the outer diameter to a first end of said second section of said piston so that said nozzle is interchangeable from said piston.

10. The apparatus of claim 9 wherein said bottom hole assembly contains a bit means for drilling a bore hole.

11. The apparatus of claim 9 wherein said bottom hole assembly further contains: a jarring means for imparting a jarring impact to said bottom hole assembly and wherein said jarring means is attached to said piston.

12. The apparatus of claim 9 wherein said bottom hole assembly contains a pulling tool.

13. The apparatus of claim 9 wherein said work string is a coiled tubing string.

14. The apparatus of claim 9 wherein said venturi means comprises:

a nozzle operatively associated with said piston;

a mixing tube, formed on said inner diameter of said piston;

a diffuser section formed on said inner diameter of said piston and adjoining said mixing tube.

15. The apparatus of claim 14 wherein said bottom hole assembly contains a bit means for drilling a bore hole.

16. The apparatus of claim 14 wherein said bottom hole assembly contains a pulling tool.

17. The apparatus of claim 14 wherein said work string is a coiled tubing string.

18. The apparatus of claim 14 wherein said work string is a drill string.

* * * * *